US006607045B2

(12) United States Patent
Beyerl

(10) Patent No.: US 6,607,045 B2
(45) Date of Patent: Aug. 19, 2003

(54) STEERING APPARATUS

(76) Inventor: Donald Beyerl, DRB Construction Inc, 4179 Rte. 8, Allison Park, PA (US) 15101

( * ) Notice: Subject to any disclaimer, the term of this patent is extended or adjusted under 35 U.S.C. 154(b) by 0 days.

(21) Appl. No.: 09/972,982

(22) Filed: Oct. 10, 2001

(65) Prior Publication Data

US 2003/0066685 A1 Apr. 10, 2003

(51) Int. Cl.[7] ..... E21B 7/04
(52) U.S. Cl. ..... 175/73; 175/76
(58) Field of Search ..... 175/24, 61, 62, 175/73, 76

(56) References Cited

U.S. PATENT DOCUMENTS

| | | | | |
|---|---|---|---|---|
| 3,526,285 | A | 9/1970 | Adkins et al. | |
| 3,630,295 | A | * 12/1971 | Coyne et al. | 175/73 |
| 3,767,836 | A | 10/1973 | Geis et al. | |
| 3,794,128 | A | 2/1974 | Gagen et al. | |
| 3,938,597 | A | 2/1976 | Richmond et al. | |
| 3,939,926 | A | 2/1976 | Barnes | |
| 3,945,443 | A | 3/1976 | Barnes | |
| 4,013,134 | A | 3/1977 | Richmond et al. | |
| 4,042,046 | A | 8/1977 | Capoccia | |
| 4,059,163 | A | 11/1977 | Stedman | |
| 4,416,339 | A | * 11/1983 | Baker et al. | 175/61 |
| 4,438,820 | A | * 3/1984 | Gibson | 175/45 |
| 5,099,927 | A | 3/1992 | Gibson et al. | |
| 5,163,520 | A | 11/1992 | Gibson et al. | |
| 5,203,418 | A | 4/1993 | Gibson et al. | |
| 5,520,255 | A | * 5/1996 | Barr et al. | 175/24 |
| 6,263,983 | B1 | 7/2001 | Wentworth et al. | |
| 2001/0011591 | A1 | * 8/2001 | Van-Drentham Susman et al. | 166/298 |

FOREIGN PATENT DOCUMENTS

| | | |
|---|---|---|
| CA | 2067802 | 5/1991 |
| CA | 2135282 | 11/1993 |
| CA | 2195002 | 6/2000 |
| EP | 0 428 181 A1 | 5/1991 |

* cited by examiner

*Primary Examiner*—William Neuder
(74) *Attorney, Agent, or Firm*—Richard C. Litman

(57) ABSTRACT

A steering apparatus for an auger in its casing to bore a horizontal hole in earth by utilizing four expandable and retractable wings equally spaced at the head of the casing. The wings are actuated by integrated single action low profile hydraulic cylinders energized by external single action hydraulic cylinders to minimize the diameter of the hole bored due to State building codes. Two embodiments of the wings are shown.

6 Claims, 5 Drawing Sheets

STEERING APPARATUS

BACKGROUND OF THE INVENTION

1. Field of the Invention

The present invention relates generally to steering apparatus. More specifically, the invention is a steering head used in auger boring for a horizontal pipe casing having four wings powered individually by single action hydraulic pumps.

2. Description of the Related Art

The related art of interest describes various steering heads used in auger boring in a pipe casing for laying a pipe horizontally, but none discloses the present invention. There is a need for limiting the diameter of the hole bored for the pipe as required by state building codes. The relevant art will be discussed in the order of perceived relevance to the present invention.

U.S. Pat. No. 3,945,443 issued on Mar. 23, 1976, to Thomas W. Barnes describes a steerable rock boring head for an earth boring means, the boring head having wedging means placed at 90° intervals at the sides, top and bottom around the inner surface of the rock head housing ring within the casing on legs of the central bearing means. Each internal wedging means includes a single acting type hydraulic cylinder for extending the wedging element and a return spring for eliminating a double acting hydraulic cylinder. Each hydraulic cylinder is fed by a line which extends back along the outer surfaces of the casing sections. However, a manual operation of the wedges is also disclosed in FIG. 4 which requires the removal of the auger and crawling into the casing sections from the rear. The apparatus is distinguishable for requiring the wedge bodies to remain inside the modified casing section and attached to the legs supporting the central bearing means.

U.S. Pat. No. 3,939,926 issued on Feb. 24, 1976, to Thomas W. Barnes et al. as a continuation-in-part of U.S. Pat. No. 3,945,443, describes a portable earth boring machine for horizontal boring, wherein the steering head is automatically controlled using four wedging means spaced at 90° intervals around the casing. The wedging means are extended using a single acting hydraulic cylinder and returned by return springs. The steering head is controlled by an automatic control panel which includes a control tube that communicates with a water gauge tube at the head of the casing. The apparatus is distinguishable for requiring the wedge bodies to remain inside the modified casing section and attached to the legs supporting the central bearing means.

U.S. Pat. No. 4,059,163 issued on Nov. 22, 1977, to Robert N. Stedman describes a mine drilling apparatus having an auger guided by a pair of adjustable guides and alignment slippers controlled by double acting hydraulic cylinders. The apparatus is distinguishable for requiring double acting hydraulic cylinders and only a pair of adjustable guides.

U.S. Pat. No. 3,526,285 issued on Sep. 1, 1970, to David E. Adkins et al. describes an angularly adjustable auger head having a mechanism for tilting the head relative to the auger axis. The tilting mechanism comprises a universal joint which couples the auger to the head assembly, and a single position plate-bearing assembly which causes angular head movement in response to energization of a hydraulic actuator. The tilting mechanism is distinguishable for requiring only one position plate.

U.S. Pat. No. 3,767,836 issued on Oct. 23, 1973, to Warren P. Geis et al. describes an earth boring method and apparatus comprising a rotary auger extending through a casing which guides the lateral cutting of the auger as it rotates. The casing is adapted to bend longitudinally whenever the hole deviated from a straight path. The casing includes circumferentially spaced rods mounted longitudinally within the casing for detecting the degree and direction of the bending of the casing. Three movable shoes or wings are mounted within a sleeve in the casing and are actuated by a control device responsive to signals received from the sensor devices to guide the casing and auger back toward the desired path. The wings are operated by long rods, a cam block rotating out on a pin. The apparatus is distinguishable for its required inner sleeve and a cam operated by lengthy rods.

U.S. Pat. No. 3,794,128 issued on Feb. 26, 1974, to Paul F. Gagen et al. describes a subterranean penetrator steering apparatus utilizing a fixed fin and a rotatable fin proximate its rear end for directing the penetrator along a desired path. The apparatus is distinguishable for its required fixed and rotatable fins.

U.S. Pat. No. 3,938,597 issued on Feb. 17, 1976, and U.S. Pat. No. 4,013,134 issued on Mar. 22, 1977, to Albert R. Richmond et al. describes a portable earth boring machine comprising a steering head having a sensing means which reads the same level as the visual gauge tube behind the engine and is connected by a hollow rod to an actuating means. The steering apparatus is distinguishable for not utilizing expandable wings.

U.S. Pat. No. 4,042,046 issued on Aug. 16, 1977, to Anastasio Capoccia describes a directional control mechanism for underground driven pipes and conduits comprising two cylindrical steering heads at the front end of the pipe to control horizontal and vertical movement. The apparatus is distinguishable for steering by movable steering heads.

U.S. Pat. No. 5,099,927 issued on Mar. 31, 1992, U.S. Pat. No. 5,163,520 issued on Nov. 17, 1992, and U.S. Pat. No. 5,203,418 issued on Apr. 20, 1993, to Paul N. Gibson et al. describes an apparatus for guiding and steering earth boring casing comprising hinge assemblies pivotally connecting a steering head to a front casing. Each hinge assembly includes two pivots for horizontal and vertical pivots. Actuators force the steering head for rotation. The apparatus is distinguishable for being limited to moving the steering head.

U.S. Pat. No. 6,263,983 B1 issued on Jul. 24, 2001, to Steven W. Wentworth et al. describes an apparatus for directional drilling comprising a drilling head having a front face angled, a housing having an electronic locating device behind the drilling head to indicate the orientation of the drilling head, and a joint at which the drilling head is removably mounted to the housing of the locating device. The apparatus is distinguishable for utilizing a movable drilling head.

E.P.O. Patent Application No. 0 428 181 A1 published on May 22, 1991, for Gerard T. Pittard et al. describes a percussion tool for drilling holes in the soil to install small diameter horizontal bore holes having two sections to allow turning under guidance of a magnetic attitude sensing system. The tool is distinguishable for lacking wings.

Canada Patent Application No. 2,067,802 published on May 24, 1991, for Johannes W. H. Van Den Bergh describes a device for steering the foremost part of a drill pipe comprising a cylindrical downhole (vertical) line having a drilling motor, a stabilizer section of enlarged diameter, a drill string, a drive motor housing, a fixed bend, another stabilizer of enlarged diameter, a bearing housing, and the bit. The apparatus is distinguishable for lacking wings.

Canada Patent Application No. 2,135,282 published on Nov. 22, 1993, for Colin Walker describes an apparatus for steering a drill bit in a curved path within a downhole comprising a first downhole motor assembly coupled to a drill bit and a second downhole motor assembly coupling the first motor assembly to the drill string. A lock sub effects rotation of the drill bit. The apparatus is distinguishable for lacking any wings.

Canada Patent Application No. 2,195,002 published on Jun. 27, 2000, for Benjamin Gray describes a method for steering a drill bit from a vertical downhole to a horizontal hole while drilling a borehole comprising a drill bit and bearing section angled to a motor, sensor and control device section, and the downhole tubing containing the communication system. The apparatus is distinguishable for not requiring wings.

None of the above inventions and patents, taken either singularly or in combination, is seen to describe the instant invention as claimed. Thus, an auger steering apparatus solving the aforementioned problems of obtaining a minimum clearance and directional ability by the use of four wings is desired.

SUMMARY OF THE INVENTION

The present invention is directed to apparatus for steering an auger in its casing to bore a horizontal hole in earth by utilizing four expandable and retractable wings equally spaced at the head of the casing. The wings are actuated by integrated single action low profile hydraulic cylinder pumps and external single action hydraulic cylinder pumps to minimize the diameter of the hole bored due to State building codes.

Accordingly, it is a principal object of the invention to provide a steering head mechanism.

It is another object of the invention to provide a steering head mechanism for auger boring.

It is a further object of the invention to provide a steering head mechanism for horizontal auger boring in earth.

Still another object of the invention is to provide a steering head mechanism for horizontal auger boring in earth with four equally spaced wings at the head of a pipe casing actuated by single action hydraulic pumps.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
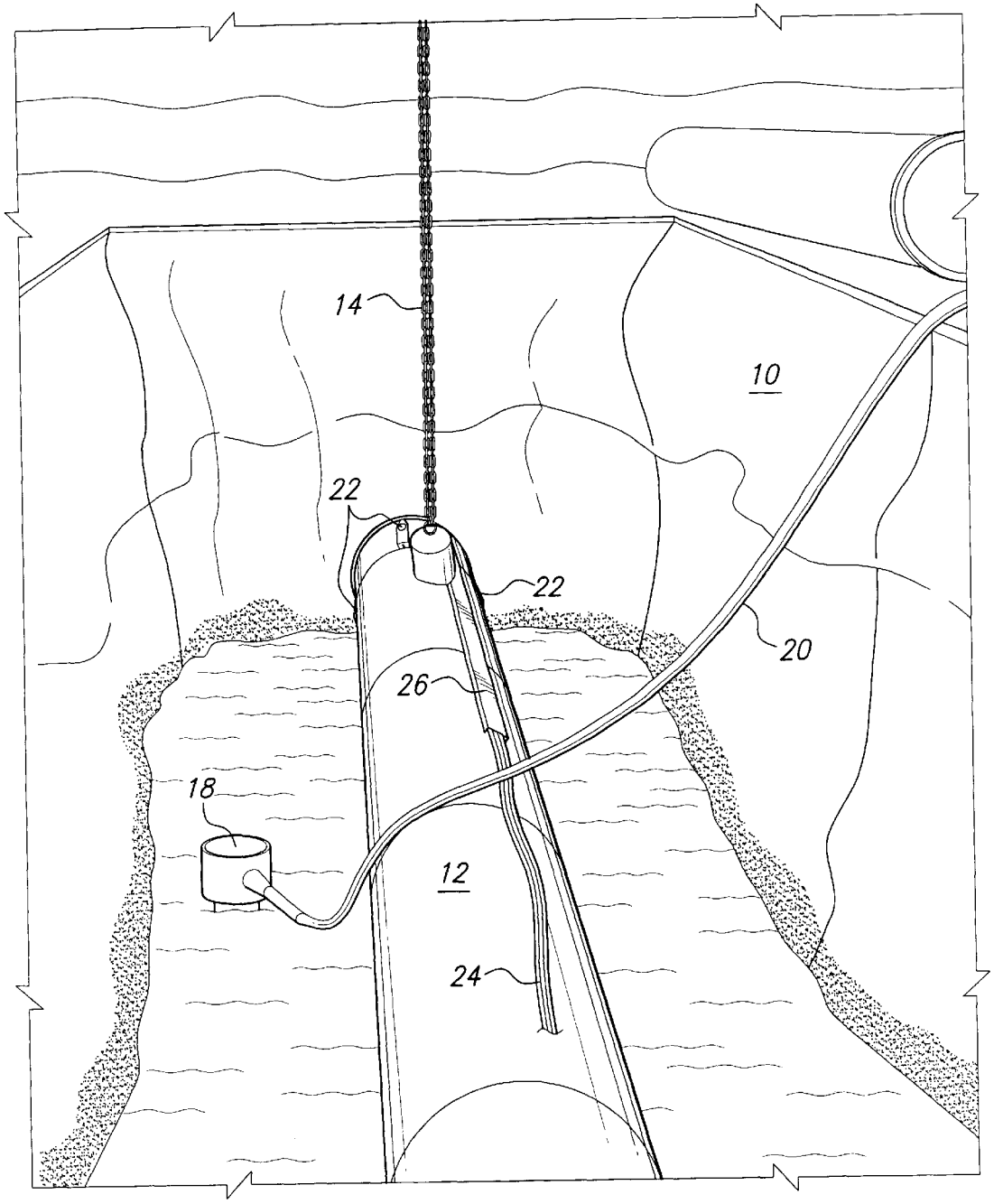
FIG. 1 is an environmental, rear perspective view of a steering apparatus on a horizontal winged pipe casing and a water level indicator bucket according to the present invention.

The present invention is directed to an apparatus for steering an auger in drilling a horizontal hole in earth with a minimum of clearance to satisfy local building codes. In FIG. 1, a pit 10 is shown with the drill casing 12 suspended by a chain 14 in water 16 measured by a water level measuring element 18 placed in the water with its electrical signal line 20 extending to the conventional control platform (not shown) on ground level. Three of the four wings 22 are shown attached to the drill casing 12 with hydraulic lines 24 from each wing 22 passing rearward under a protective shield 26.

Figure 2:
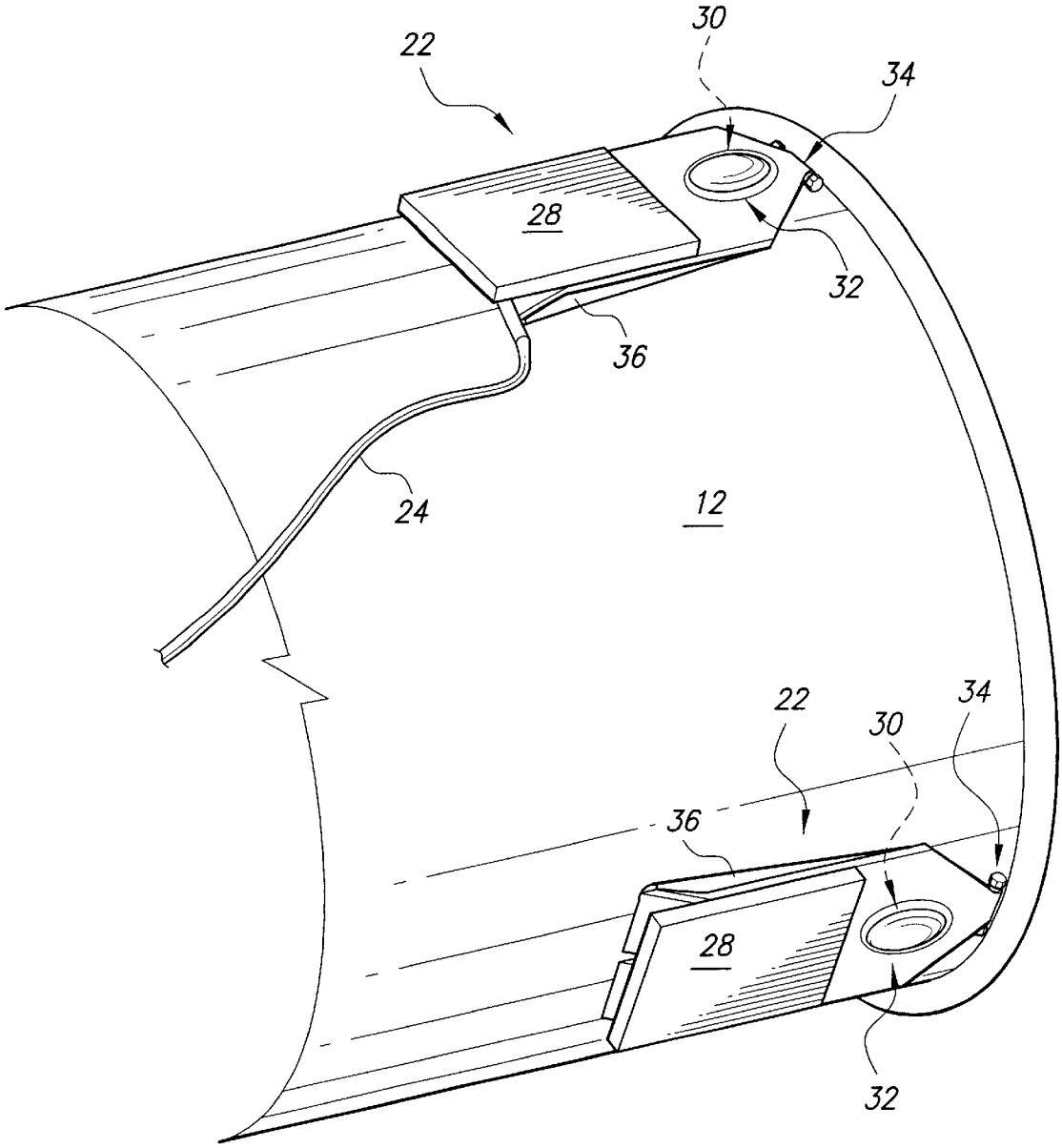
FIG. 2 is a partial environmental, perspective view of a pipe casing with a first embodiment of a wing reinforced with a plate.

FIG. 2 illustrates the front portion of an empty drill casing 12 having two wings 22 exposed with rectangular steel plates 28 welded to the planar top plates of the expandable wings which are each expandable by a short or low profile hydraulic pump 30 hidden under the round projection 32. These first embodiment wings 22 can expand from their hinge point 34 from 1.5 to 7 inches. A base plate 36 supports the wings. The planar base plate 36 and the planar top plates have at their proximate ends a truncated triangular shape to house the hinge 34. The protective shields 26 for the hydraulic lines 24 have been omitted.

Figure 3:
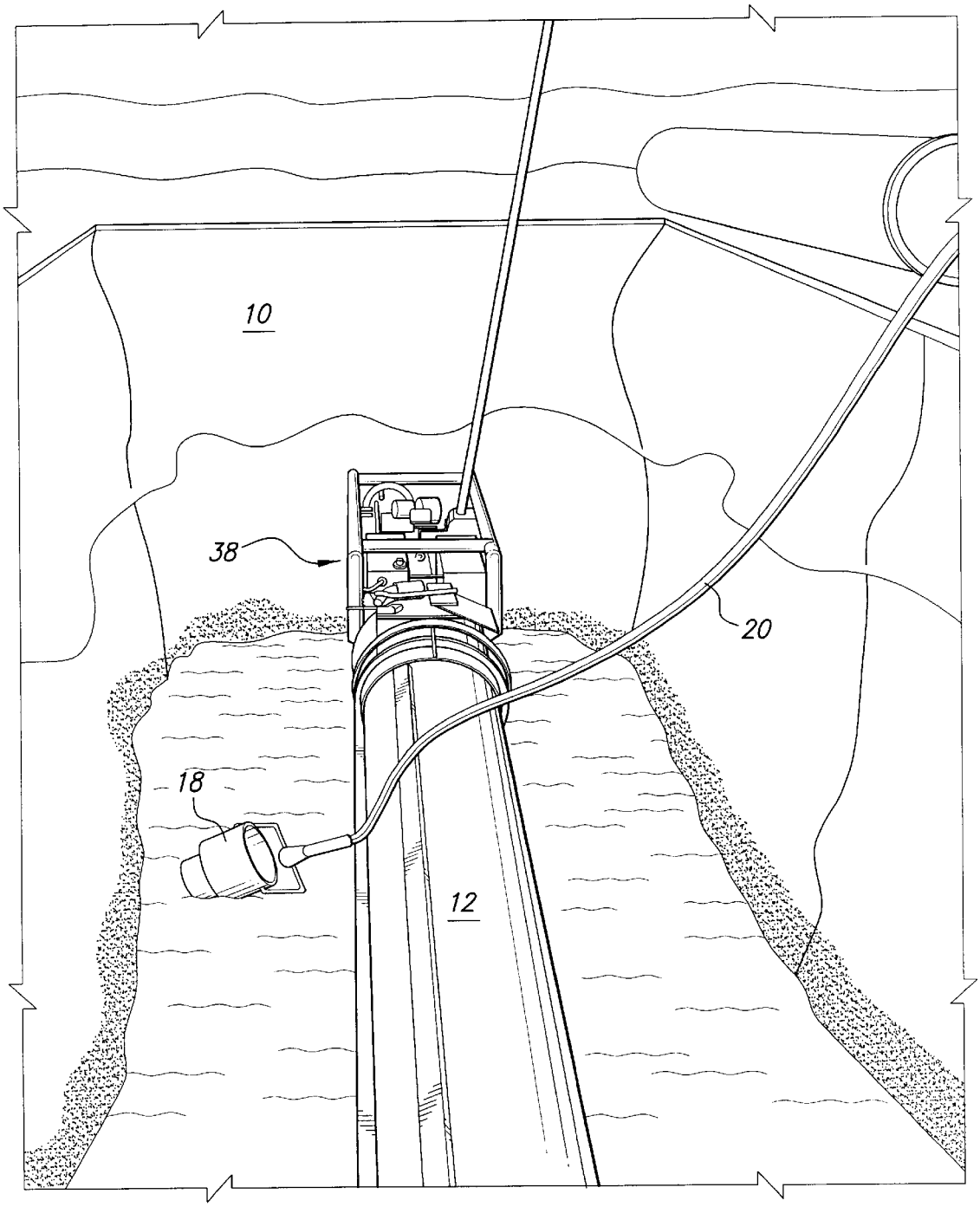
FIG. 3 is an environmental, perspective view of a boring machine attached to the pipe casing.

In FIG. 3, the boring machine 38 is shown at the opposite end of the drill casing 12 connected to an auger and its bit which are hidden. The water level measuring element 18 in the water 16 in the pit 10 with its line 20 is shown.

Figure 4:
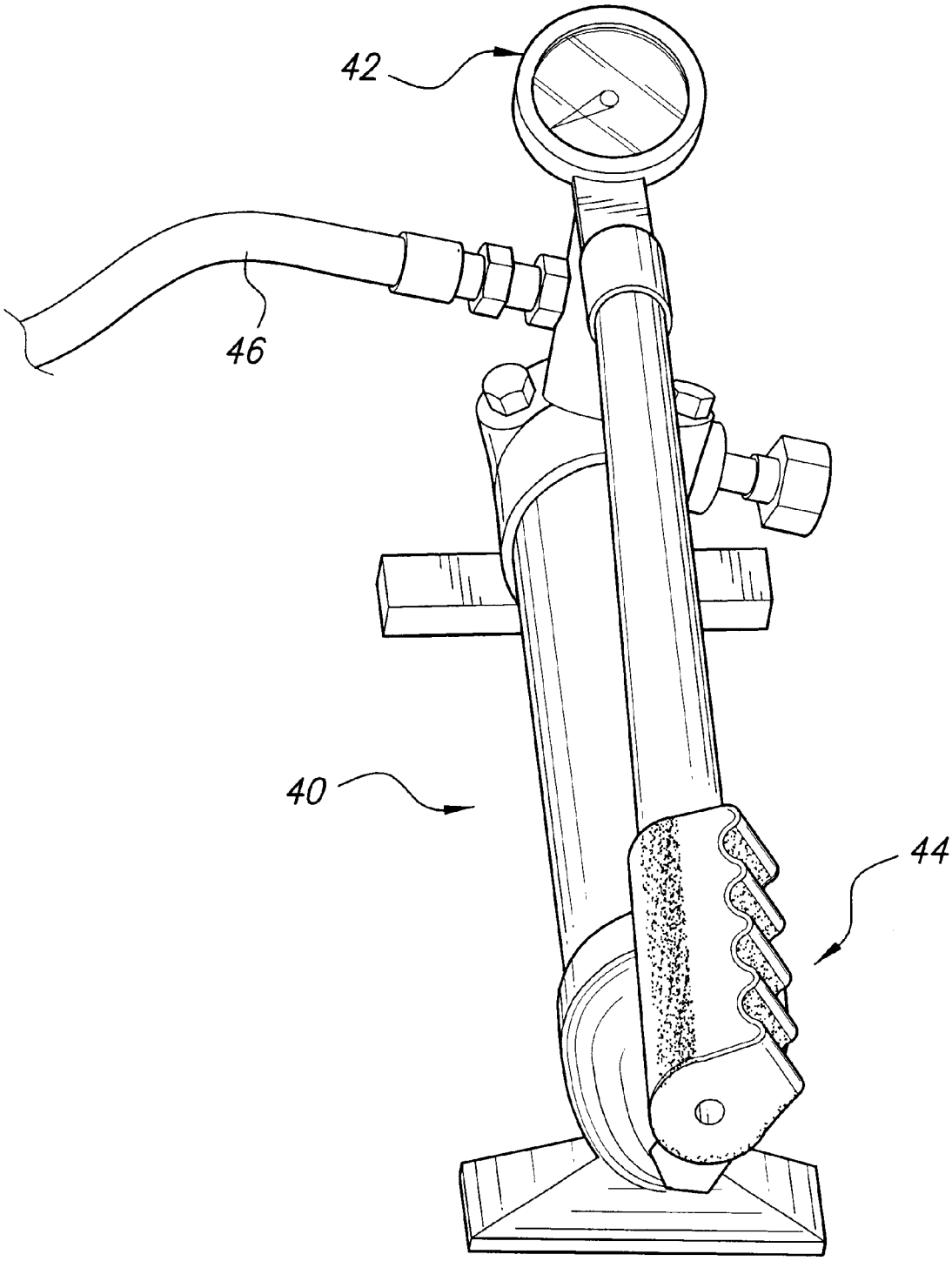
FIG. 4 is a perspective view of one hydraulic cylinder with its pressure gauge, hand pump, and line controlling one of the four wings on the pipe casing.

FIG. 4 shows a single hydraulic pump 40 utilized to pump one wing 22 with its pressure meter 42, hand pump 44, and hose 46. The electrical controls showing the direction of the drill casing 12 are conventional and located in the control platform.

Figure 5:
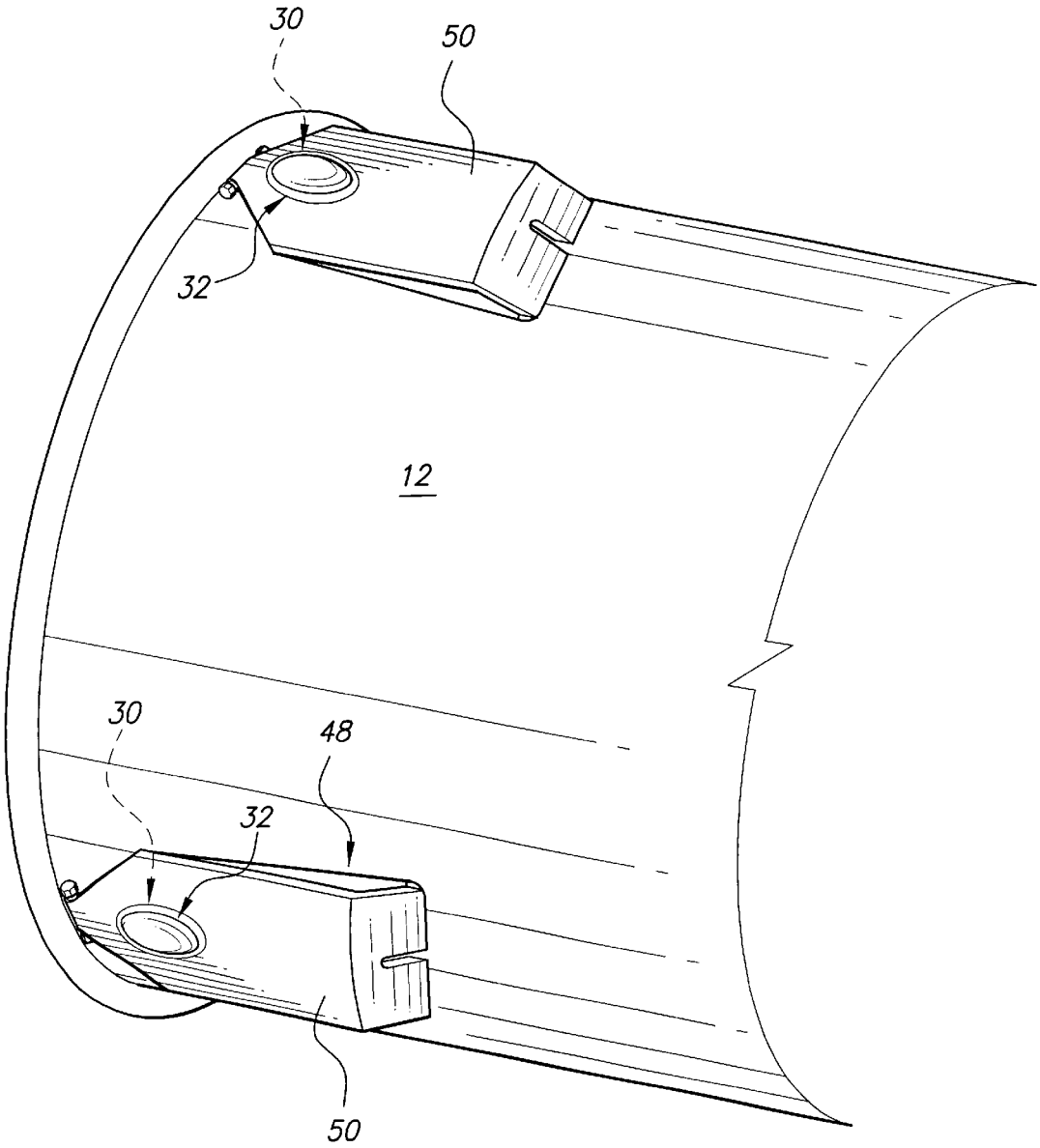
FIG. 5 is a partial side elevational view of a front section of the pipe casing equipped with a second embodiment of the wings with a slotted cover.

FIG. 5 illustrates a second embodiment of two wings 48 mounted on a drill casing 12 with each wing having a hinged cover 50 having a slotted flange 52 at its distal end for the hydraulic hose connection (not shown). This embodiment has an expansion range from 1.5 to 5 inches.

Thus, two embodiments of wings for a steering wing apparatus system have been shown which control the direction of the drill casing and minimize the clearance between the pipe and its tunnel as mandated by local codes.

It is to be understood that the present invention is not limited to the embodiments described above, but encompasses any and all embodiments within the scope of the following claims.

I claim:

1. A steering wing apparatus system for attaching to a pipe casing of an auger digging horizontally comprising:

a planar base plate and a hinge means, said base plate having a conical truncated proximate end ending in said hinge means;

a substantially planar top plate having a shape commensurate to that of the base plate, circular protuberance adjacent said hinge means and connected to said base plate by said hinge means;

a low profile hydraulic cylinder included under said protuberance and between said top plate and said base plate; and a hydraulic hose connected to said low profile hydraulic cylinder;

whereby the steering wing apparatus can be expanded and contracted via the low profile hydraulic cylinder to direct the horizontal digging of the auger in the pipe casing auger;

wherein a rectangular plate is attached on a distal end of the top plate for enhancing the amount of expansion capability of the wing apparatus.

2. The steering wing apparatus system according to claim 1, wherein an expansion range of the distal end of the top plate is from 1.5 to 7 inches.

3. The steering wing apparatus system according to claim 1, wherein four wings are attached equidistantly on the pipe casing of the auger for control of the direction of the digging.

4. A steering wing apparatus system for attaching to a pipe casing auger digging horizontally comprising:

a planar base plate and a hinge means, said base plate having a conical truncated proximate end ending in said hinge means;

a substantially planar top plate having a shape commensurate to that of the base plate, circular protuberance adjacent said hinge means and connected to said base plate by said hinge means;

a low profile hydraulic cylinder included under said protuberance and between said top plate and said base plate; and a hydraulic hose connected to said low profile hydraulic cylinder;

whereby the steering wing apparatus can be expanded and contracted via the low profile hydraulic cylinder to direct the horizontal digging of the auger in the pipe casing auger;

wherein the substantially planar top plate has a vertical flange extending down from it's distal end.

5. The steering wing apparatus system according to claim 4, wherein the vertical flange has a slot for accommodating the hydraulic hose.

6. The steering wing apparatus system according to claim 4, wherein the steering wing can expand 1.5 to 7 inches.

* * * * *